US005136819A

United States Patent [19]

Takagi et al.

[11] Patent Number: 5,136,819

[45] Date of Patent: Aug. 11, 1992

[54] METHOD FOR MIRROR POLISHING OF TI-MADE MAGNETIC DISK SUBSTRATE

[76] Inventors: Masakuni Takagi; Hiroyoshi Takeuchi, c/o; Hideaki Fukai; Toshio Sakiyama; Hiroyoshi Suenaga; Kuninori Minakawa, all of NKK Corporation of No. 1-2, Marunouchi, 1-chome, Chiyoda-ku, Tokyo, Japan

[21] Appl. No.: 649,076

[22] Filed: Feb. 1, 1991

[30] Foreign Application Priority Data

Feb. 2, 1990 [JP] Japan ..... 2-22057

[51] Int. Cl.[5] ..... B24B 1/00

[52] U.S. Cl. ..... 51/281 R; 52/132; 52/281 SF

[58] Field of Search ..... 51/281 SF, 133, 132, 51/131.1, 131.3, 131.4, 131.5, 131.2, 165.9, 118; 51/281 R

[56] References Cited

U.S. PATENT DOCUMENTS 3,486,274 12/1969 David ..... 51/132
4,962,616 10/1990 Wittstock ..... 51/132

FOREIGN PATENT DOCUMENTS 2063685 3/1987 Japan ..... 51/165.9
2190243 7/1990 Japan ..... 51/4

OTHER PUBLICATIONS

Polishing Technique for Titanium; Pochnow; Applied Optics vol. 23, No. 23, p. 4279 Dec. 1984.

Polishing Compound Semiconductors; Jensen; Solid State Technology; vol. 16, No. 8, pp. 49–52 Aug. 1973.

*Primary Examiner*—Robert A. Rose

[57] ABSTRACT

According to a mirror surface polishing process of the present invention, it is possible to produce Ti-made magnetic disc substrate which have the excellent flatness degree and surface roughness in that the average roughness is not more than 0.05 μm and the flatness degree of the outer periphery is not more than 0.15 μm.

3 Claims, 3 Drawing Sheets

METHOD FOR MIRROR POLISHING OF TI-MADE MAGNETIC DISK SUBSTRATE

FIELD OF THE INVENTION

The present invention relates to a method for mirror polishing two surfaces of Ti or Ti alloy plates to be used to magnetic disc substrate.

PRIOR OF THE ART

Ti and Ti alloy (called briefly as "Ti" hereinafter) are excellent in cleanliness, and more excellent in heat resistance in comparison with Al alloys, and so they have been desired to be used to magnetic disc substrate of high quality. However, since Ti is a material with less workability, it is difficult to finish the material with mirror surfaces having both of satisfied flatness degree and surface roughness, and therefore required characteristics as the magnetic disc substrate could not be obtained.

With respect to the surface roughness, electrolytic abrasive grain grinding process has recently been studied aggresively. For example, Japanese Patent Laid-Open No.60-217018 proposes a method of using an electrolytic solution containing fine abrasive grains (1500 to 8000 meshes) and surface active agent is used so as to electrolyze and elude Ti as anode, and scrubbing the surface of the magnetic disc substrate at abrasive pressure of 0.05 to 3 kgf/cm$^3$, thereby to provide the surface roughness of not more than 0.1 μm Rmax.

Another method is to control the abrasive pressure by a grinding wheel so as to obtain mirror surfaces without surface defects.

However, with the former electrolytic abrasive grain grinding process, it is difficult to obtain flatness degree of the disc substrate and prevent the dispersion of the electrolytic current on the treated surfaces. The satisfactory surface roughness may be easily obtained in the small areas, but in more or less large areas an adjusting device and a control of the electrolytic current are very complicated, whereby a practice is actually difficult.

On the other hand, the latter abrasive technique is an effective method where the well conditioned surface roughness and the flatness degree may be obtained over a wide area by means of an easy operation, but has difficulties about the flatness degree of the outer periphery thereof. That is, in the magnetic disc substrate, in order to increase the recording capacity, such an attempt is made to secure the flatness degree of the outer periphery (especially from the center of the base plate to 40–46 mm, i.e., from R40 mm to R46 mm) for recording nearly the outer periphery. But, since Ti is less workable than Al, the abrasion is available only at the outer periphery of the magnetic disc substrate which is large at peripheral velocity during abrasion, so that Ti is difficult to obtain the flatness degree of the outer periphery.

SUMMARY OF THE INVENTION

The present invention has been devised in view of problems as above mentioned of the prior art, and is to propose a process of polishing a mirror surface of Ti-made magnetic disc substrate, which is excellent not only in the surface roughness but also in the flatness degree of the outer periphery of the substrate by controlling the treating conditions in a finish polishing using an abrasion cloth which is relatively small in the polishing velocity.

For accomplishing an object of the present invention, Ti-made magnetic disc substrate is subjected to a finish polishing with the abrasive cloth by controlling pressure on the surface thereof not lower than 10 g/cm$^2$ and not more than 100 g/cm$^2$ and determining a processing time between not less than 5 min and not more than 60 min, thereby to provide such Ti-made magnetic disc substrate which are excellent in that the average surface roughness is not more than 0.05 μm, and the flatness degree of the outer periphery between R40 mm and R46 mm is not more than 0.15 μm.

The finish polishing using the abrasion cloth is a final process for removing abrasion scratches caused by the grinding wheel in a preceding process so as to provide mirror surfaces. However since the abrasion velocity is slow in the finish polishing of Ti materials, the polishing is easily effected only at the outer periphery of the Ti-made magnetic disc substrate, where the peripheral velocity is larger during the polishing, so that the part thereabout becomes easily tired and eared.

Thereupon the inventors repeated detailed investigations and experiments on the relation with the polishing pressure, polishing time, mirror surface and flatness degree of the outer periphery, and got the following conclusion.

In the final polishing using the abrasion cloth, the abrasion scratch caused by the grinding wheel should be removed. As a result of studying the relation between the finish polishing condition and the surface roughness in view of such a situation, for providing the mirror surface of the average roughness being not more than 0.05 μm, it has been proved that the pressure to the surface to be processed should be not lower than 10 g/cm$^2$ and the processing time be not shorter than 5 minutes. If the pressure is less than 10 g/cm$^2$ or the processing time is shorter than 5 minutes, the abrasive scratches remain and the mirror surface could not be provided.

On the other hand, for determining the flatness degree of R40 mm to R46 mm to be not more than 0.15 μm, it has been proved that the pressure to the surface to be processed should be not more than 100 g/cm$^2$, and a processing time be within 60 minutes. If the pressure exceeds 100 g/cm$^2$, and the processing time is longer than 60 minutes, the mirror surface may be provided, but the flatness degree of the outer periphery could not be obtained. Herein, "R" shows a distance (mm) from the center of the Ti-made disc substrate.

DETAILED DESCRIPTION OF THE PREFERRED EMBODIMENTS (EXAMPLES)

Explanation will be made to exprimental examples of processing the mirror surface.

Two kinds of sold pure Ti cold rolled plates of 1 mm thickness (equivalent to JIS-H-4600, TP35C) were stamped into discs of 3.5 inch diameter and ground thereon. The both surfaces were then ground by firstly performing the rough abrasion by the grinding wheel and thereafter performing the finish polishing by the abrasive cloth.

The abrasion by the grinding wheel in the rough abrasion process depended upon the grain roughness from 400 to 800, 1500, 3000 and 4000 meshes. As the grains of the grinding wheel, two kinds of silicon carbide and alumina were used. The abrasion solution contained alumina of 38 $cm^3$ in grain diameter of not more than 2 μm to the maximum and hydrogen peroxide of 200 ml.

On the other hand, the polishing pressure in the final polishing was adjusted between 5 $g/cm^2$ and 150 $g/cm^2$, and the finish polishing time was changed from 3 min to 90 min. The flatness degree and the surface roughness between R40 mm and R46 mm were measured at three positions at random so as to study the relation between the average values and the finish polishing conditions. The flatness degree was measured by a non-contacting flatness tester, and the surface roughness was measured by a non-contacting contacting surface roughness tester so as to obtain central average roughness.

Figure 1:
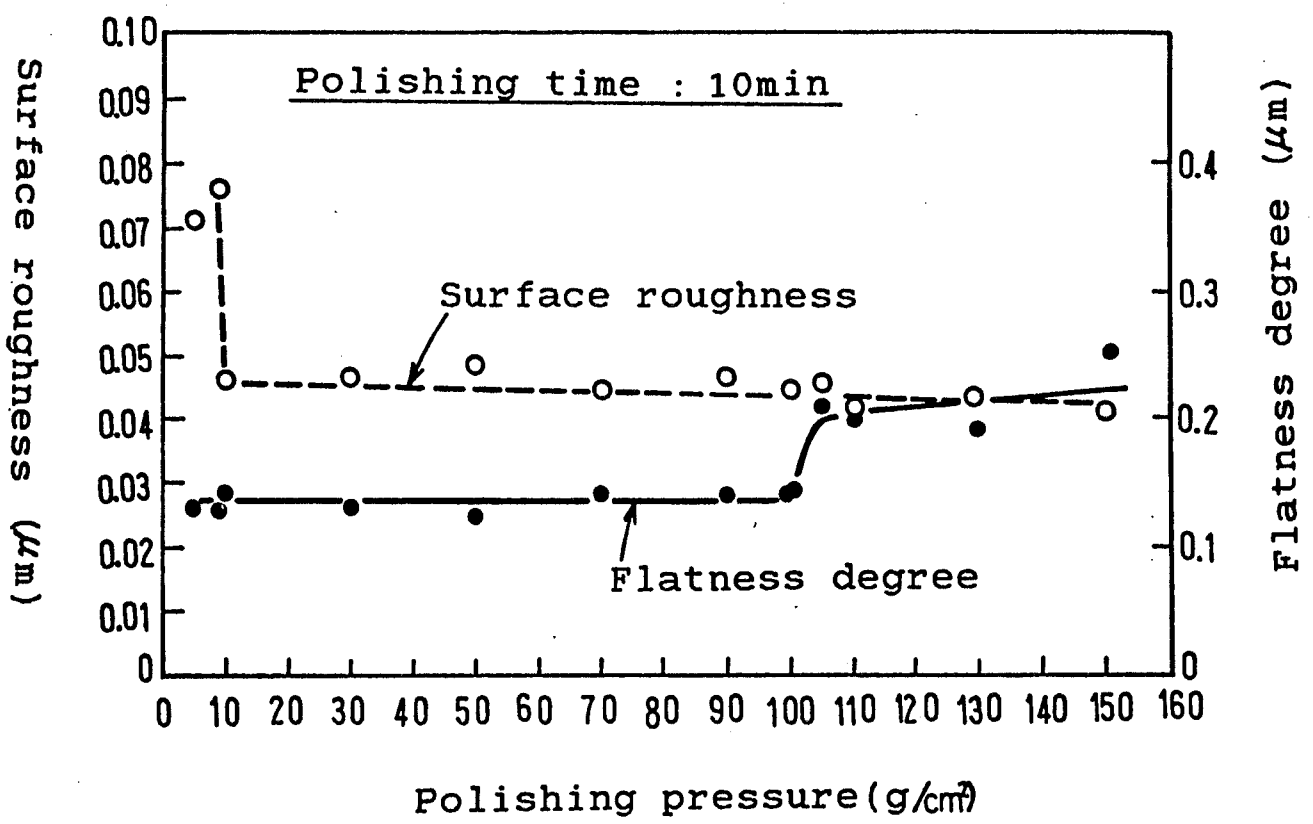
FIG. 1 is a graph showing results of measuring the surface roughness and the flatness degree by changing the polishing pressure at the determined time in experimental examples of practising the inventive process.
Figure 2:
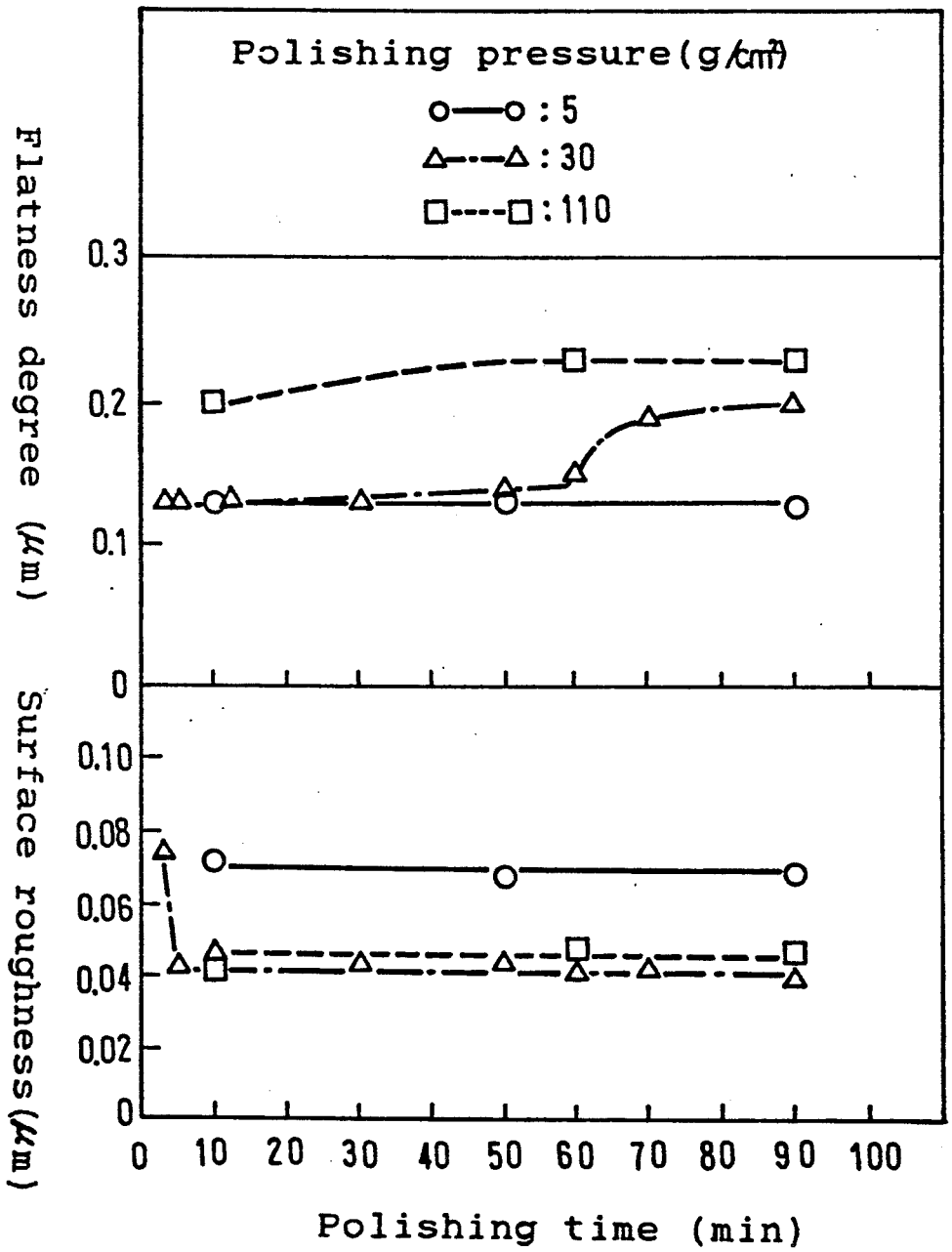
FIG. 2 is a graph showing results of measuring the surface roughness and the flatness degree by dividing the polishing pressure into three classes, and changing the polishing pressure at the determined time.
Figure 3:
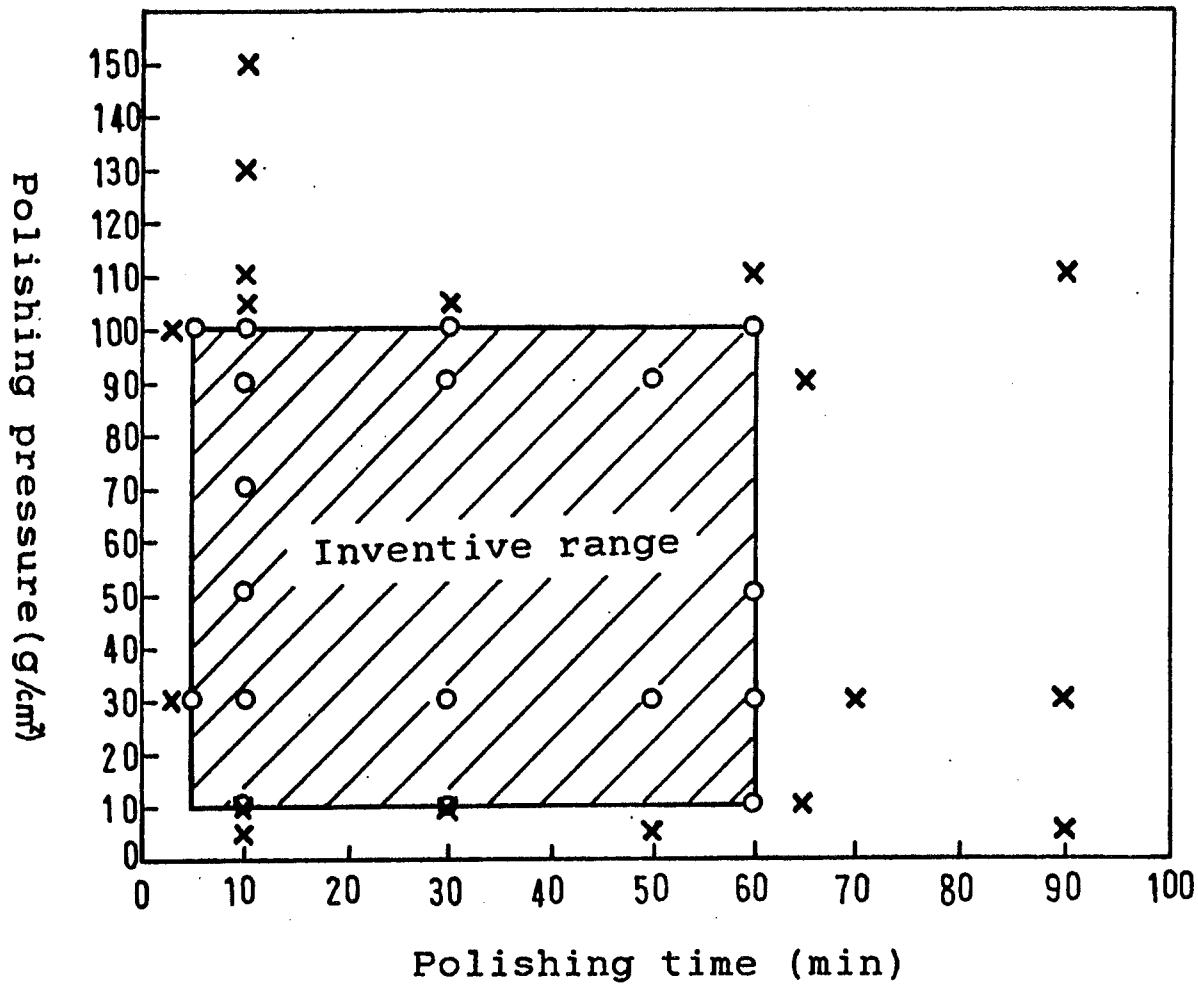
FIG. 3 is a graph showing results of measuring the surface roughness and the flatness degree by variously changing the polishing pressure and the flatness degree.

The results obtained as above are shown in FIGS. 1 to 3.

FIG. 1 shows the results of measuring the surface roughness and the flatness degree at the polishing time of 10 min and by changing the polishing pressure from 5 to 150 $g/cm^2$.

In order that the surface roughness is made to be not more than 0.05 μm as shown in the same, the polishing pressure should be not lower than 10 $g/cm^2$. In order that the flatness degree of the outer periphery is made not more than 0.15 μm, the polishing pressure should be not more than 100 $g/cm^2$.

FIG. 2 shows the results of measuring the surface roughness and the flatness degree at the polishing pressures of 5 $g/cm^2$, 30 $g/cm^2$ and 110 $g/cm^2$, and changing the polishing time from 3 to 90 min.

If the polishing pressure is, as shown in the same, set to be 30 $g/cm^2$ within the inventive range, the polishing time should be taken not less than 5 min in order that the surface roughness is made not less than 0.05 μm (when the polishing pressure was 5 $g/cm^2$, the surface roughness could not be made not more than 0.05 μm, though the polishing time was 90 min).

Similarly, if the polishing pressure is set 30 $g/cm^2$, the polishing time should be set within 60 min, in order that the flatness degree of the outer periphery is made not more than 0.15 μm (when the polishing pressrue was 110 $g/cm^2$, the flatness degree of the outer periphery could not be made not more than 0.15 μm, though the polishing time was as short as not longer than 60 min).

FIG. 3 summerizes the measured results shown in FIGS. 1 and 2, and the results of additional tests and measures, in which "O" designates condition of the surface roughness being not more than 0.05 μm and the flatness degree being not more than 0.15 μm, and "X" designates cases outside of such conditions.

It is seen from the results shown in the graphs that as far as keeping the inventive conditions, it is possible to produce the Ti-made magnetic disc substrate which have the excellent flatness degree and surface roughness in that the average roughness is not more than 0.05 μm and the flatness degree of the outer periphery is not more than 0.15 μm.

What is claimed is:

1. A method of polishing a circular shaped titanium magnetic disk, comprising the steps of rough abrading at least one surface of the disk using a grinding wheel having a roughness of between 400 to 4,000 mesh, and an abrasion solution comprising alumina of 38 $cm^3$ and having a grain diameter of not more than 2 μm, and hydrogen peroxide of 200 ml;

finish polishing the at least one surface using an abrasion cloth and controlling pressure on the at least one surface to be between 10 to 100 $g/cm^2$; and controlling the processing time to be between 5 and 60 minutes so as to produce an average surface roughness of not more than 0.05 μm, and a flatness, as measured between 40 mm to 46 mm from a center point of said disk, of not more than 0.15 μm.

2. The method of claim 1, wherein the grinding wheel comprises grains of alumina.

3. The method of claim 1, wherein the grinding wheel comprises grains of silicon carbide.

* * * * *